US009259659B2

(12) United States Patent
Sopinsky et al.

(10) Patent No.: US 9,259,659 B2
(45) Date of Patent: Feb. 16, 2016

(54) TWIST-WAIST PUNCHING FIGURE

(71) Applicant: Mattel, Inc., El Segundo, CA (US)

(72) Inventors: Brandon Sopinsky, Los Angeles, CA (US); Zeng Wu, ShenZhen (CN); Alan Fang, ShenZhen (CN); Mario E Aguirre, Paramount, CA (US); Ruben L Martinez, Whittier, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 13/873,660

(22) Filed: Apr. 30, 2013

(65) Prior Publication Data

US 2014/0323012 A1 Oct. 30, 2014

(51) Int. Cl.
*A63H 3/20* (2006.01)
*A63H 13/06* (2006.01)

(52) U.S. Cl.
CPC ..... *A63H 13/06* (2013.01)

(58) Field of Classification Search
CPC ..... A63H 3/28; A63H 3/006; A63H 13/06; A63H 3/20; A63H 3/48; A63H 13/00; A63H 3/46; A63H 3/14; A63H 7/00; A63H 11/18; A63H 13/08; A63H 13/12; A63H 29/22; A62H 3/00
USPC ..... 446/330, 333, 334, 336, 338, 339, 340
See application file for complete search history.

(56) References Cited

U.S. PATENT DOCUMENTS

| | | | | | |
|---|---|---|---|---|---|
| 3,154,881 | A | * | 11/1964 | Elwell | 446/24 |
| 3,648,405 | A | | 3/1972 | Tepper | |
| 3,672,096 | A | * | 6/1972 | Johmann | 446/338 |
| 3,754,351 | A | | 8/1973 | Glass et al. | |
| 3,947,994 | A | * | 4/1976 | Meyer et al. | 446/336 |
| 3,986,295 | A | * | 10/1976 | Keller | 446/320 |
| 4,003,158 | A | | 1/1977 | Wolf et al. | |
| 4,031,657 | A | * | 6/1977 | Crosman et al. | 446/333 |
| 4,182,075 | A | * | 1/1980 | James | 446/298 |
| 4,457,097 | A | * | 7/1984 | Miller et al. | 446/327 |
| 4,536,166 | A | | 8/1985 | Renger et al. | |
| 4,553,946 | A | * | 11/1985 | Miller | 446/327 |
| 4,560,362 | A | | 12/1985 | Renger | |
| 4,595,378 | A | | 6/1986 | Sweet et al. | |
| 4,601,672 | A | | 7/1986 | Cook et al. | |
| 4,623,318 | A | | 11/1986 | Tsiknopoulos et al. | |
| 4,626,224 | A | | 12/1986 | Benson et al. | |

(Continued)

FOREIGN PATENT DOCUMENTS

| | | | |
|---|---|---|---|
| CA | 2526773 | A1 | 1/2005 |
| CA | 2549492 | A1 | 12/2006 |

(Continued)

*Primary Examiner* — Vishu Mendiratta

(74) *Attorney, Agent, or Firm* — Kolisch Hartwell, P.C.

(57) ABSTRACT

A toy figure, with an upper torso; a shoulder flange rotatably mounted on the upper torso; and an extendable arm pivotally mounted to the shoulder flange. The extendable arm may pivot with respect to both the shoulder flange and the upper torso to extend away from the upper torso, and includes an elbow that allows the extendable arm to straighten and bend. The toy figure includes an actuating mechanism disposed within the upper torso that forces the extendable arm to pivot and extend away from the upper torso. A tie rod may interconnect the shoulder flange to a portion of the extendable arm through the elbow so that so that pivotal movement of the arm around the shoulder flange causes the extendable arm to straighten.

12 Claims, 8 Drawing Sheets

(56) References Cited

U.S. PATENT DOCUMENTS

| | | | | |
|---|---|---|---|---|
| 4,639,234 | A | 1/1987 | Atwood | |
| 4,723,932 | A | 2/1988 | Kelley et al. | |
| 4,750,900 | A * | 6/1988 | Hart | 446/308 |
| 4,968,280 | A | 11/1990 | Kelley | |
| 5,042,807 | A * | 8/1991 | Sasakawa et al. | 273/440.1 |
| 5,046,987 | A * | 9/1991 | Djordjevic | 446/336 |
| 5,290,185 | A * | 3/1994 | Murakami | 446/334 |
| 5,389,031 | A | 2/1995 | Sharpe, III et al. | |
| 6,022,263 | A | 2/2000 | Liu et al. | |
| 6,106,359 | A | 8/2000 | Arriola | |
| 6,160,986 | A | 12/2000 | Gabai et al. | |
| 6,227,931 | B1 | 5/2001 | Shackelford | |
| 6,296,543 | B1 | 10/2001 | Andrews | |
| 6,506,095 | B1 | 1/2003 | Lund et al. | |
| 6,558,225 | B1 | 5/2003 | Rehkemper et al. | |
| 6,579,143 | B1 | 6/2003 | Rehkemper et al. | |
| 6,616,502 | B1 | 9/2003 | Pacza-Steim et al. | |
| 6,666,745 | B1 | 12/2003 | Lund et al. | |
| 6,672,935 | B1 | 1/2004 | Lund et al. | |
| 6,736,693 | B1 | 5/2004 | Lund et al. | |
| 6,776,682 | B2 | 8/2004 | Engel et al. | |
| 6,959,166 | B1 | 10/2005 | Gabai et al. | |
| 7,182,340 | B1 | 2/2007 | Tim | |
| 7,207,564 | B2 | 4/2007 | Bedford et al. | |
| 7,326,101 | B2 | 2/2008 | Engel et al. | |
| 7,537,506 | B2 | 5/2009 | De La Torre | |
| 7,551,523 | B2 | 6/2009 | Larian | |
| 7,575,496 | B2 | 8/2009 | Lau et al. | |
| 7,654,881 | B2 | 2/2010 | Nakazato et al. | |
| 7,695,340 | B2 | 4/2010 | Nakazato et al. | |
| 7,722,426 | B2 | 5/2010 | Campbell | |
| 8,092,271 | B2 | 1/2012 | Garbos et al. | |
| 8,337,271 | B2 | 12/2012 | Campbell et al. | |
| 2004/0043696 | A1 | 3/2004 | Suzuki | |
| 2005/0159072 | A1 | 7/2005 | Brown et al. | |
| 2006/0003664 | A1 | 1/2006 | Yeh | |
| 2006/0111013 | A1 | 5/2006 | Lau et al. | |
| 2006/0270313 | A1 | 11/2006 | Campbell | |
| 2006/0270317 | A1 | 11/2006 | Campbell | |
| 2006/0270318 | A1 | 11/2006 | Campbell | |
| 2006/0270320 | A1 | 11/2006 | Proch | |
| 2006/0270321 | A1 | 11/2006 | Benedict | |
| 2006/0292965 | A1 * | 12/2006 | Strauss | 446/376 |
| 2008/0023913 | A1 | 1/2008 | Barthold et al. | |
| 2009/0075555 | A1 | 3/2009 | Barthold | |
| 2009/0209170 | A1 | 8/2009 | Richter | |
| 2011/0086571 | A1 | 4/2011 | O'Hare | |
| 2011/0227871 | A1 | 9/2011 | Cannon | |
| 2011/0281492 | A1 | 11/2011 | Chan | |

FOREIGN PATENT DOCUMENTS

| | | | |
|---|---|---|---|
| CA | 2654298 | A1 | 12/2007 |
| GB | 2180769 | A | 4/1987 |
| MX | 2008015693 | A | 3/2009 |
| WO | 2005000415 | A2 | 1/2005 |
| WO | 2006052449 | A2 | 5/2006 |
| WO | 2006128000 | A2 | 11/2006 |
| WO | 2006133064 | A2 | 12/2006 |
| WO | 2006133067 | A2 | 12/2006 |
| WO | 2006133279 | A2 | 12/2006 |
| WO | 2007056465 | A2 | 5/2007 |
| WO | 2007056530 | A2 | 5/2007 |
| WO | 2007104029 | A2 | 9/2007 |
| WO | 2007117708 | A2 | 10/2007 |
| WO | 2007146302 | A2 | 12/2007 |
| WO | 2011119552 | A2 | 9/2011 |

* cited by examiner

TWIST-WAIST PUNCHING FIGURE

FIELD OF THE DISCLOSURE

This disclosure relates to an action figure with an internal twist-structure that causes a punching action in both a standing posture and a flying posture. An internal mechanism allows the action figure to move with a punching motion when the arms are pointed away from the torso, in a standing position, and when the arms are pointed above the head, in a flying position.

BACKGROUND OF THE DISCLOSURE

Action figures have been a staple toy for young children, typically young boys, for many years. A market arose for action figures that resembled popular icons of the time period. Some examples of popular action figures over the past have been G.I. Joe, Batman, Superman, He-Man and Skeletor, Teenage Mutant Ninja Turtles, Transformers and many more.

Design and manufacturing processes for action figures have been generally similar and well known. For the most part, action figures are made from plastic pieces that are sculpted and molded from clay. The plastic pieces may be joined together in different ways depending on the desired effect, such as fixed, rotatable, pivotable, etc. The outcome is an action figure that has human-like movements and would be intuitive to a young child playing with the toy.

Over time, action figures have become more sophisticated having moving interconnected parts, lights and sound effects. These aspects provide additional benefits that make the action figure more realistic, diverse in function, and aesthetically pleasing.

Examples of such systems are disclosed in U.S. Pat. Nos. 7,537,506; 7,182,340; 6,579,143; 6,296,543; 6,022,263; 4,723,932; 4,623,318; 4,601,672; 4,536,166; and 4,003,158; and Patent Application Nos. US20110086571 and US20060292965. The disclosures of these and all other publications referenced herein are incorporated by reference in their entirety for all purposes.

SUMMARY OF THE DISCLOSURE

The present invention relates to an action figure, which includes an upper torso; a pivoting lever disposed within the upper torso; a shoulder flange rotatably mounted to the upper torso and including a passageway extending from within the upper torso; an upper arm pivotally mounted to the shoulder flange; a sliding plunger operatively connecting the pivoting lever to the upper arm through the passageway so that the pivoting lever slides the plunger through the shoulder flange and forces the upper arm to pivot with respect to the shoulder flange; a lower arm pivotally mounted to the upper arm; and a tie rod interconnecting the shoulder flange to the lower arm so that pivotal movement of the upper arm around the shoulder flange causes the lower arm to pivot with respect to the upper arm; a lower torso rotatably mounted to the upper torso and operatively connected to the pivoting lever; wherein rotation of the lower torso forces the pivoting lever to pivot with respect to the upper torso causing simultaneous pivoting of the upper arm with respect to the shoulder flange and pivoting of the lower arm with respect to the upper arm.

Advantages of the present disclosure will be more readily understood after considering the drawings and the Detailed Description.

Figure 1:
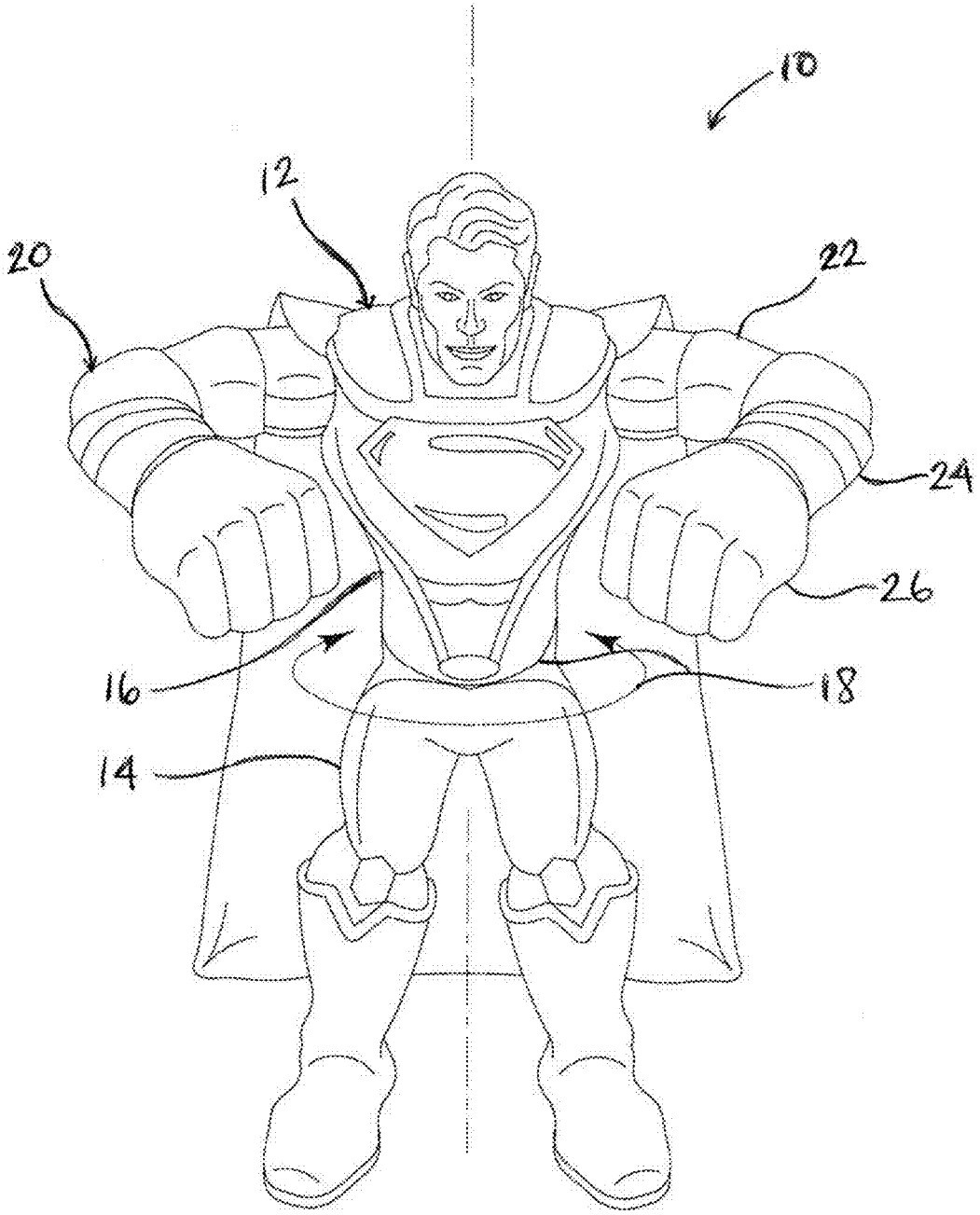
FIG. 1 shows a front top view of an action figure with two arms, and with each arm pointed away from a torso, and with the torso in a standing position.
Figure 2:
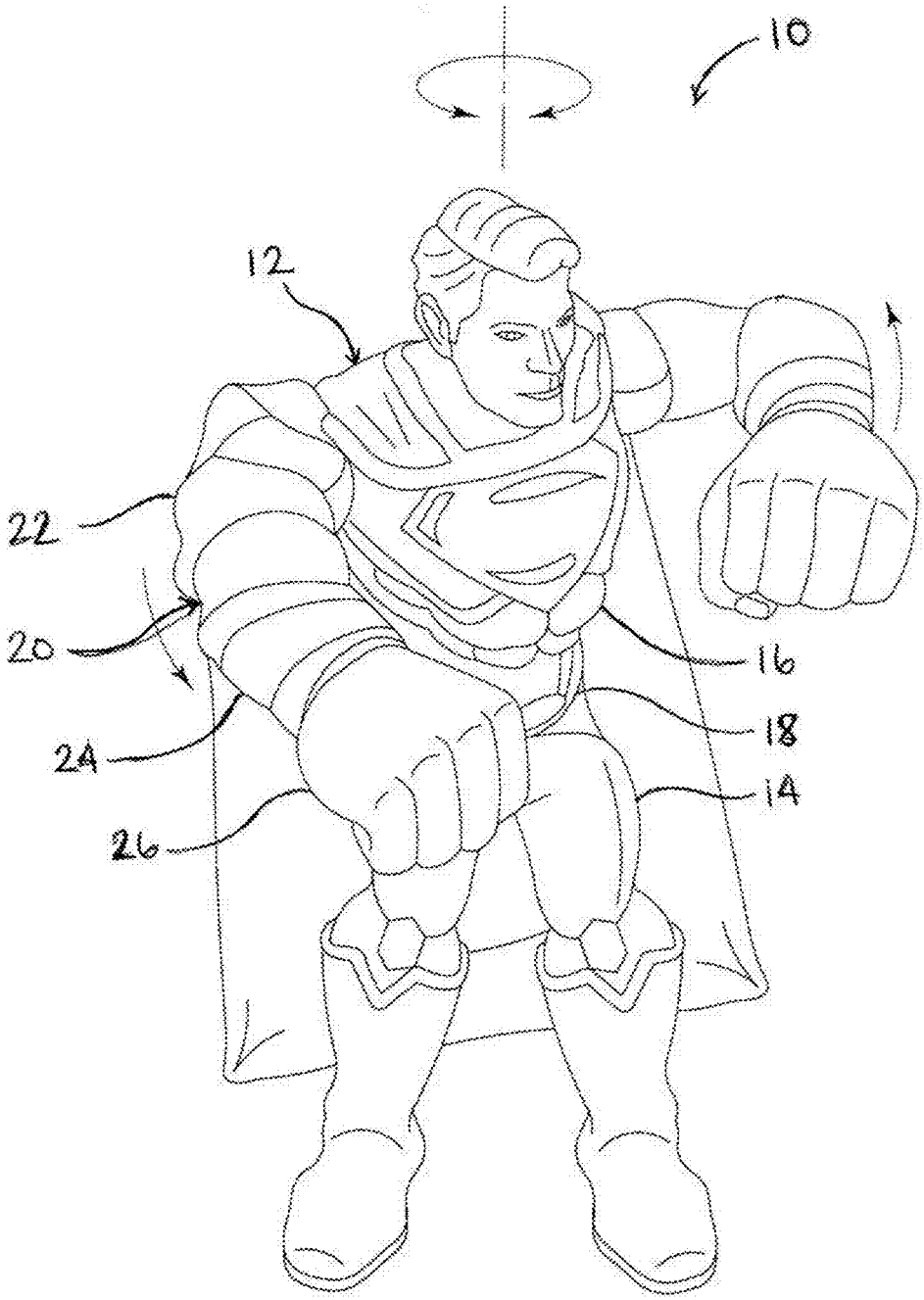
FIG. 2 shows a front top view of the action figure of FIG. 1, with an upper torso rotated relative to a lower torso, and with a right arm extended in a punching position.
Figure 3:
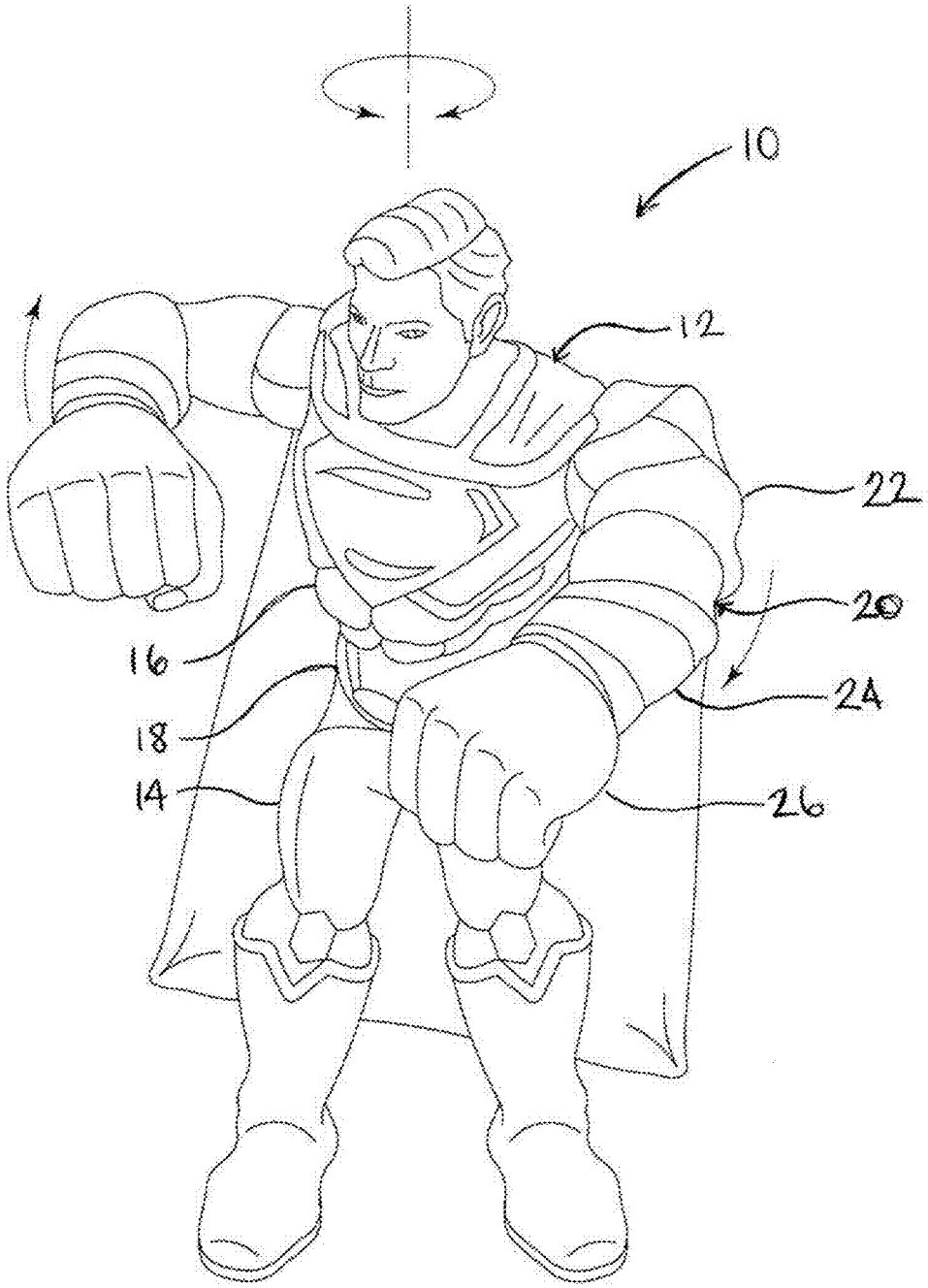
FIG. 3 shows a front top view of the action figure of FIGS. 1 and 2, with the upper torso rotated relative to a lower torso in an opposite direction when compared to FIG. 2, with the right arm pointed away from the torso as in FIG. 1, and a left arm extended in a punching position.
Figure 4:
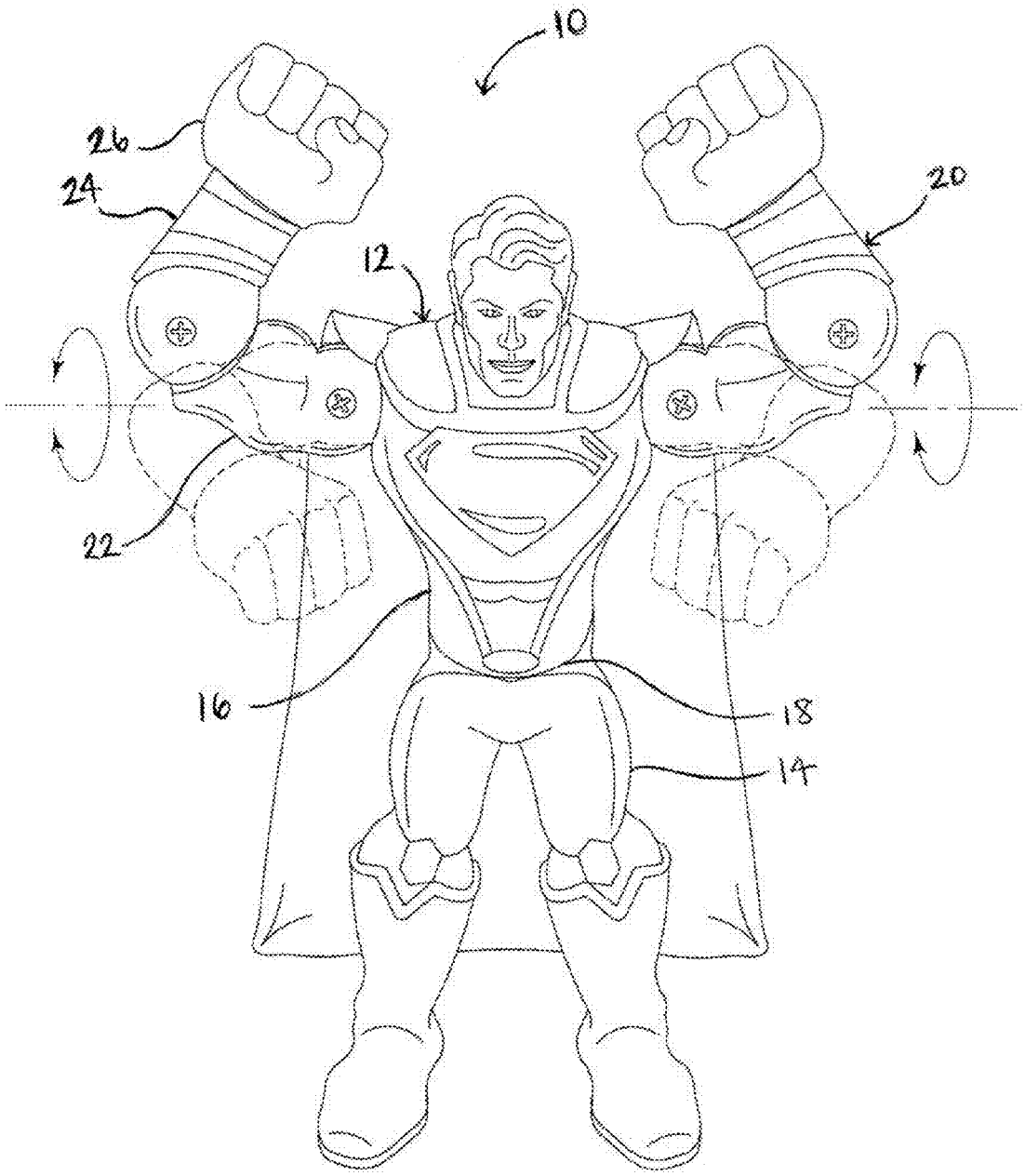
FIG. 4 shows a front top view of the action figure of FIG. 1, with the two arms rotated to an upright position.

The drawings illustrate embodiments and schematic concepts for twist-waist punching figures according to the invention. The purpose of these drawing is to aid in explaining the principles of the invention. Thus, the drawings should not be considered as limiting the scope of the invention to the embodiments and schematic concepts shown therein. Other embodiments of a twist-waist punching figure may be created which follow the principles of the invention as taught herein, and these other embodiments are intended to be included within the scope of patent protection.

DETAILED DESCRIPTION OF THE DISCLOSURE

Examples of a twist-waist punching figure are shown in FIGS. 1-7. Unless otherwise specified, a toy figure may, but is not required to contain at least one of the structure, components, functionality, and/or variations described, illustrated, and/or incorporated herein.

A toy figure in accordance with the present disclosure, shown in FIGS. 1-7 and as described in further detail below, is a unique and versatile toy figure. The toy figure may include an arm that is rotatably mounted to a body and an actuation mechanism that, when activated, causes the arm to extend in a punching motion while allowing the arm to maintain various desired angles relative to the body. For example, rotating the arm to a horizontal position, perpendicular with the body, and activating the actuation mechanism may create the appearance of a punching fist. In another example, rotating the arm to an upright position, parallel with the body, and activating the actuation mechanism may create the appearance of a toy figure with super powers, flying though the air and punching forward, or of a toy figure standing with a fist rising in the air as if expressing solidarity. This actuation mechanism may create a unique and versatile action feature.

In a first example, shown in FIGS. 1-7, a toy figure, indicated generally at 10, includes a body 12, preferably formed from a lower torso 14 and an upper torso 16. Lower torso 14 may rotate relative to upper torso 16 about a waist 18. Upper torso 16 includes an extendable arm 20 formed with an upper arm 22, a lower arm 24, and, optionally, a hand 26. Extendable arm 20 is rotatably mounted to upper torso 16 by an arm-rotating mechanism 28, which allows extendable arm 20 to rotate and be held in various desired angles relative to upper torso 16.

Lower torso 14 may include a driving lever 30 that reaches into upper torso 16 and drivingly connects to a pivoting lever 32. Pivoting lever 32 preferably includes a lower end 34 and an upper end 36, and pivots about a pintle 38 disposed within the upper torso 16. The upper end 36 of the pivoting lever 32 selectively pushes a plunger 40 formed as part of extendable arm 20.

Figure 6:
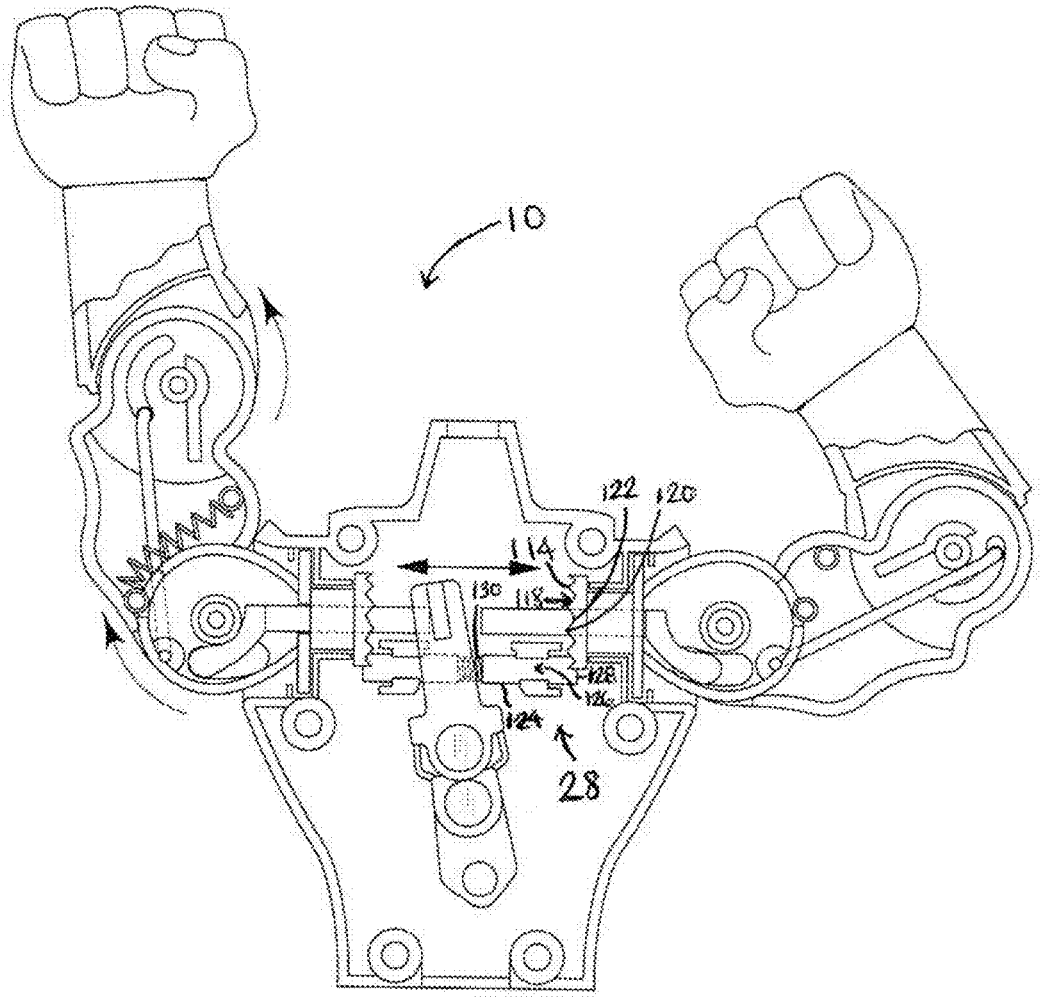
FIG. 6 shows a cross-sectional plan view of the upper torso and arms of the action figure of FIG. 5, with the actuation mechanism activated to cause the right arm to extend in a punching motion.

A plunger 40 slides into the extendable arm 20 through a shoulder flange 42 and operatively connects to upper arm 22. Pushing on plunger 40 forces upper arm 22 to pivot with respect to both shoulder flange 42 and upper torso 16. Upper arm 22 and shoulder flange 42 may further include an arm-biasing element 44, preferably a coil spring 44 as shown in FIG. 6, operatively connected between shoulder flange 42 and upper arm 16 to bias upper arm 16 toward an unextended position when plunger 40 is allowed to slide back to a starting position, by releasing any driving forces on pivoting lever 32.

An elbow 46 allows the extendable arm 20 to straighten and bend about elbow 46, by movement of lower arm 24 relative to upper arm 22. A tie rod 48 interconnects shoulder flange 42 to lower arm 24 through elbow 46 so that so that pivotal movement of upper arm 22 around shoulder flange 42 causes extendable arm 20 to straighten. Releasing any driving forces on pivoting lever 32 allows plunger 40 to slide back to a starting position, pivoting upper arm 22 around shoulder flange 42 which causes extendable arm 20 to bend.

Figure 8A:
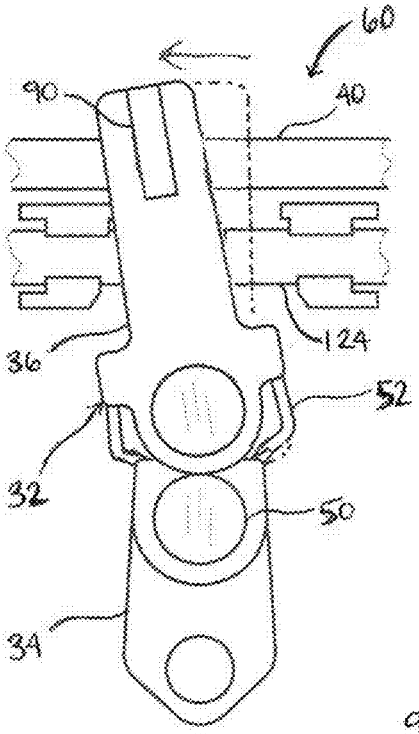
FIGS. 8A, 8B, and 8C show a pivoting lever in detail, taken from FIG. 5, with the lever bent to the left in FIG. 8A, the lever in a straight configuration in FIG. 8B, and the lever bent to the right in FIG. 8C.
Figure 8C:
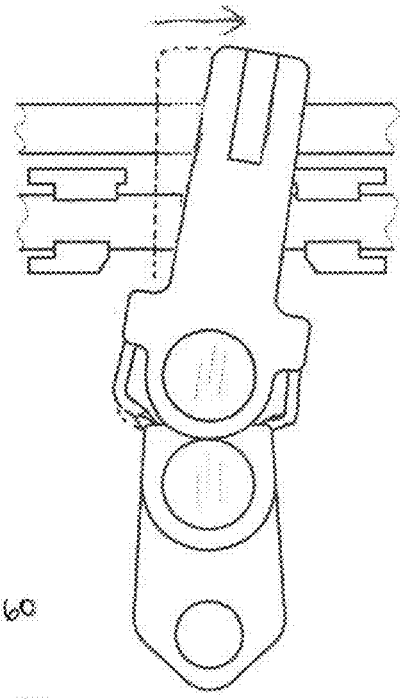
Figure 8B:
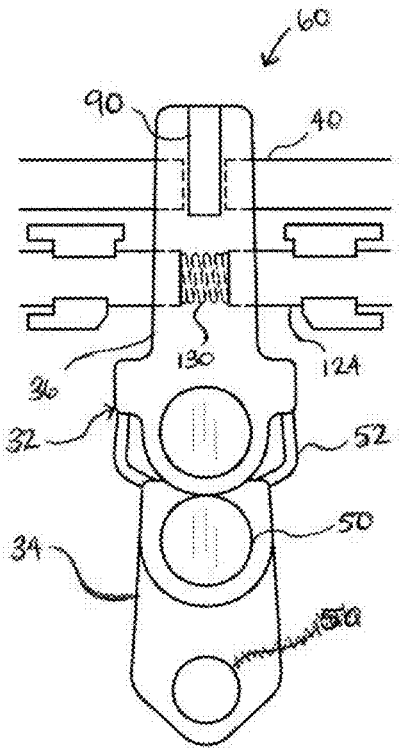

Optionally, pivoting lever 32 may include an intermediate pivot 50 which may provide stress relief to pivoting lever 32 in a situation where upper end 36 of pivoting lever 32 is forced in the same direction as lower end 34. For example, a child playing with toy figure 10 may try to force lower torso 14 to move relative to upper torso 16, and at the same time try to force lower arm 24 or upper arm 22 to move relative to upper torso 16, counter to the driving forces caused by movement of lower torso 14. Intermediate pivot 50 allows pivoting lever 32 to bend, and helps to avoid breaking the various internal components described above. A spring 52, or other bias element 52, biases pivoting lever 32 a normal straight configuration. This bending movement is shown in FIGS. 8A and 8C, with the normal straight configuration shown in FIG. 8B.

Similarly, a waist-biasing element 54 is operatively connected to the upper torso 16 and lower torso 14. Element 54 may be a spring, allowing forced swiveling of the waist 18 and then returning the waist 18 to the unswivelled position once force is no longer applied.

Figure 5:
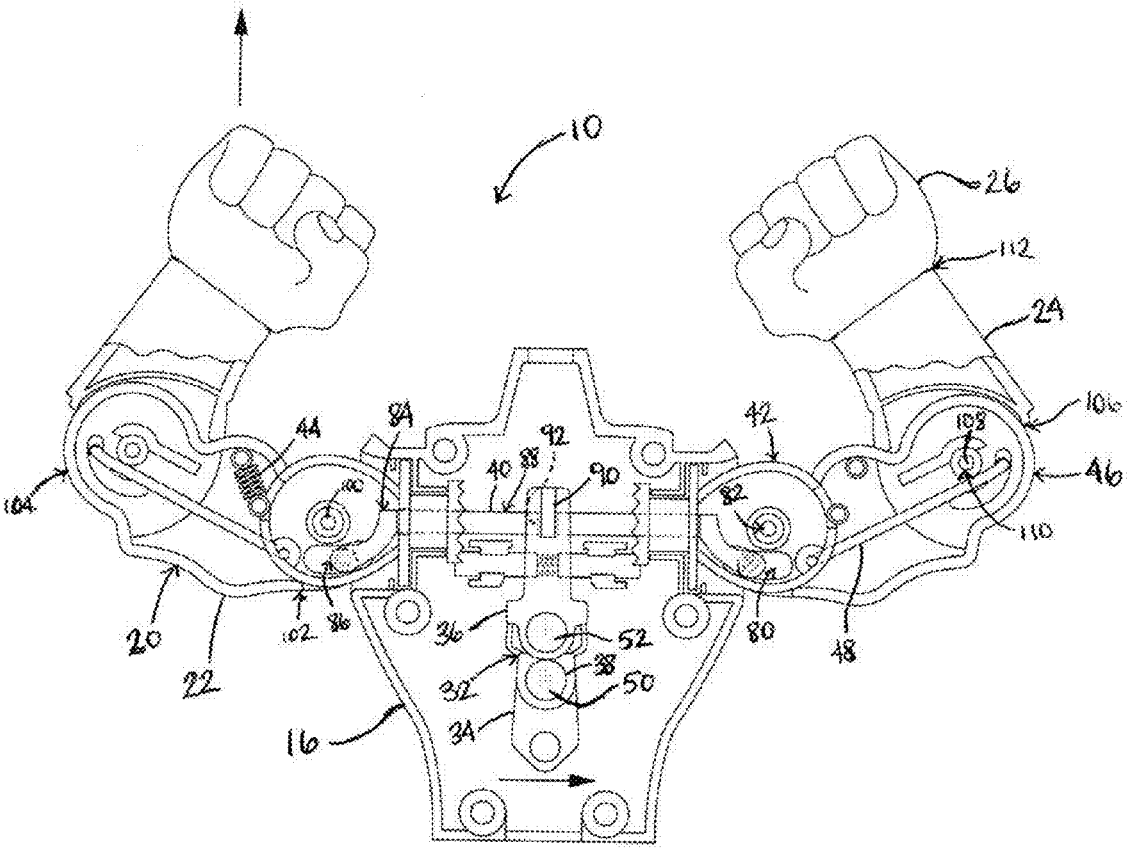
FIG. 5 shows a cross-sectional plan view of the upper torso and arms of the action figure of FIG. 4, including an internal an actuation mechanism.

FIG. 5 shows a preferred embodiment of a shoulder flange 42, which contains an arcuate opening 80 that curves around a center point 82. Outer end 84 of the plunger 40 within shoulder flange 42 has a post 86 that passes through the arcuate opening 80 and operatively connects to the upper arm 22. When the plunger 40 slides within shoulder flange 42, post 86 moves the upper arm 22 along a path guided by arcuate opening 80.

Inner end 88 of the plunger 40 extends outward from the shoulder flange 40 into the upper torso 16. Within upper torso 16, a paddle 90 is located on the upper end 36 of pivoting lever 32. A surface 92 on the inner end 88 of the plunger 40 may be pushed on by paddle 90 to drive plunger 40 into the shoulder flange 40.

Shoulder flange 42 further includes an axle 100, which enables the pivotal mounting of the upper arm 22 to shoulder flange 42. Axle 100 is disposed within center point 82 and fixedly mounted to a shoulder end 102 of the upper arm 22. Thus, the shoulder end 102 of the upper arm 22 is pivotally connected to the shoulder flange 42 by the axle 100.

Similarly, the lower arm 24 further includes an axle 108, which enables the pivotal mounting of the upper arm 22 to lower arm 24. Axle 108 is disposed within a hole 110 of lower arm 24 and fixedly mounted to an elbow end 106 of the lower arm 24. Thus, the elbow end 106 of the lower arm 24 is pivotally connected to the elbow end 104 of the upper arm 22 by the axle 108. Optionally, the lower arm 24 may further include a hand end 112 which hand 26 is rotatably mounted.

Details of arm-rotating mechanism 28, which allows extendable arm 20 to rotate and be held in various desired angles relative to upper torso 16, include a positioning disc 114 that is fixedly mounted to shoulder flange 42. Positioning disc 114 has a wavy surface 118 with higher portions 120 and lower portions 122 that receive a securing pin 124. Securing pin 124 may have a narrowing end 128 to allow precise seating of securing pin 124 between higher portions 120 of positioning disc 114.

Furthermore, a pin-channel 126 is fixed to upper torso 16 that allows securing pin 124 to slide while properly being retained within pin-channel 126. A pin-biasing element 130 urges securing pin 124 along pin-channel 126 into operative contact with the positioning disc 114. During forced rotation of the positioning disc 114, securing pin 124 will rise over higher portions 120 and fall into lower portions 122. Once forced rotation of the positioning disc 114 ceases, pin-biasing element 130 will urge securing pin 124 along the pin-channel 126 where narrowing end 128 may slide down from higher portion 120 into lower portion 122 of the positioning disc 114 and hold the positing disc 114 in place.

Another embodiment may include the following specific play patterns.

A Superman figure that has battery-operated lights and sounds. For example, when a crest is pressed, it will activate lights on the torso, and an internal speaker will annunciate various phrases.

A child playing with this Superman figure may activate a punching action and sounds when the waist is rocked left and right. This Superman figure will be able to activate punching action and sound when hands are rotated upward and waist is rocked left and right.

In some embodiments, toy figure 10 may include a sound emitter such as a speaker connected to prerecorded sounds and voice, and or a light emitter. Such emitters are common in toys, and typically include a power source such as a battery. An activation pushbutton may be provided in the form of a momentary contact switch that is triggered when components of toy figure 10 move relative to one another, or when manually pushed by a user. For example, toy figure 10 may include a semi-transparent shield on the chest, with an LED under the shield so that light may be seen through the chest. The shield may connected to a pushbutton switch so that light and or sound is emitted when the shield is pushed by a user. The sound may include a catchy or recognizable phrase to give the special effect that the toy figure is speaking.

Alternatively, or in addition, an electrical switch may be pushed by rotation of lower torso 14 relative to upper torso 16. The sound emitted may be an impact and/or crumbling sound to give the effect of the toy figure punching and/or breaking an object.

In yet another alternate embodiment, a foot switch may be placed in the bottom of a foot of toy figure 10, so that when the toy figure is standing on solid ground the foot switch may be in one position, and when the toy figure is in the air the foot switch may be in a second position. The foot switch may cause the electronics to emit various sounds, such as a sound that indicates the toy figure is a massive object hitting solid ground when the foot switch is activated, or a sound that indicates the toy figure blasts off from solid ground and takes flight. For example, a Superman figure may activate flight sounds when a trigger on the foot is released. When this embodiment of the action figure is in flight mode and a trigger is pressed during a landing it will have an impact sound effect.

The following paragraphs may provide further information regarding example embodiments.

In one embodiment, toy figure 10 includes upper torso 16, shoulder flange 42 rotatably mounted on upper torso 16, and extendable arm 20 pivotally mounted to shoulder flange 42 so that extendable arm 20 may rotate with respect to upper torso 16. Preferably extendable arm 20 is connected with rotatable joints that have sufficient friction and stiction so that extendable arm 20 may be rotated by a child playing with toy figure 10, but then may be held in a desired position.

Actuating mechanism 60 positioned within upper torso 16 forces extendable arm 20 into movement around shoulder flange 42 away from upper torso 16. Tie rod 48 interconnects shoulder flange 42 to a portion of extendable arm 20 through elbow 46 so that so that movement of extendable arm 20 around shoulder flange 42 causes extendable arm 20 to straighten, as shown for the right arm in FIG. 6. As extendable arm 20 pivots around shoulder flange 42, elbow 46 may straighten from a bent position, simulating a realistic and natural arm movement.

Preferred embodiment of elbow 46 include arm-biasing element 44 that coerces extendable arm 20 in a bent position. FIGS. 5 and 6 show arm-biasing element 44 as a coil spring 44 operatively connecting shoulder flange 42 to extendable arm 20. In this example, activation of actuating mechanism 60 places an opposite force on arm-biasing element 44, which allows extendable arm 20 to straighten, as shown for the right arm in FIG. 6. Once force is released from actuating mechanism 60, arm-biasing element 44 contracts extendable arm 20 to the bent position, as shown for the right arm in FIG. 5.

Figure 7:
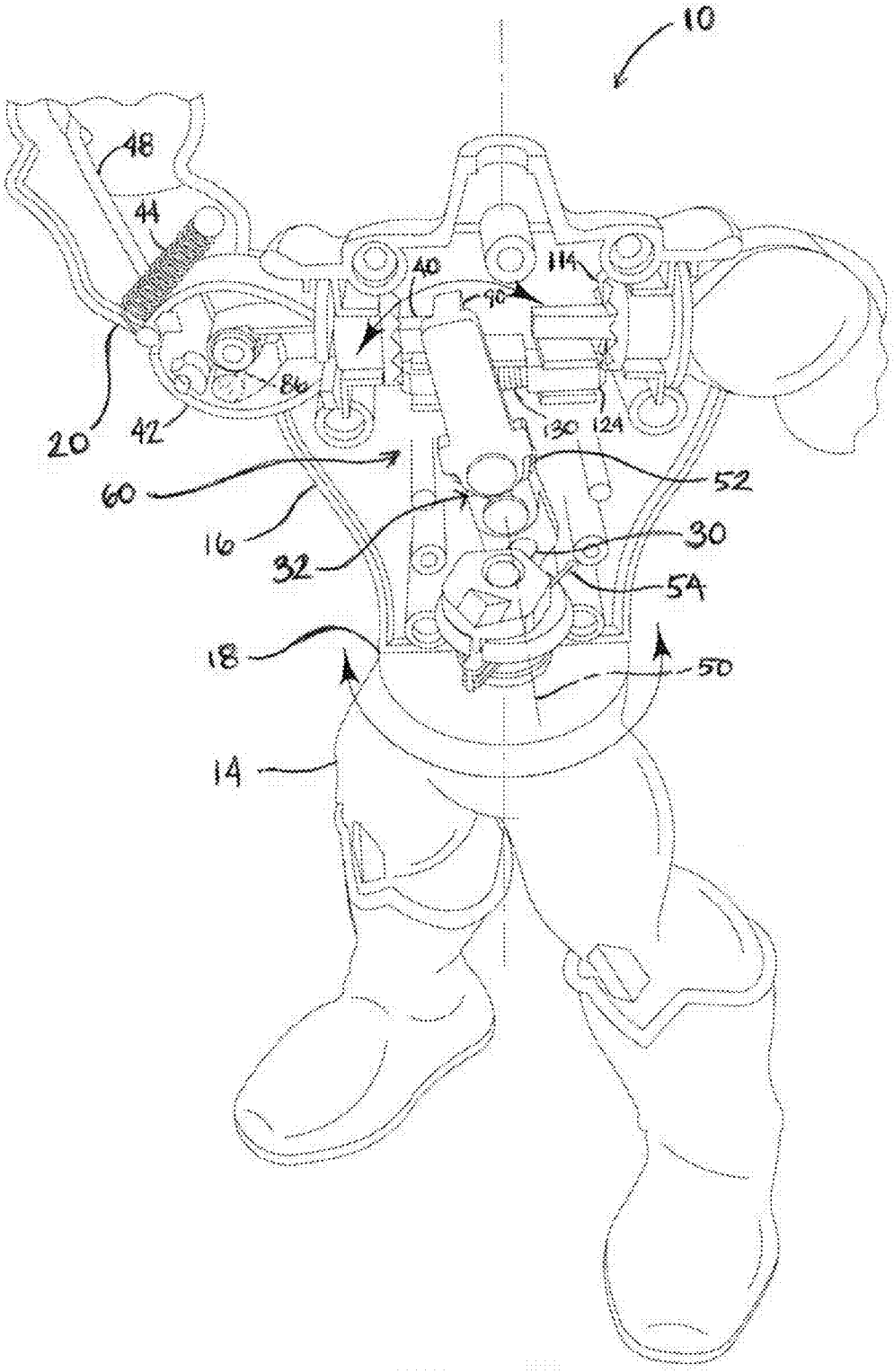
FIG. 7 shows a front top view of the action figure of FIG. 4, with the upper torso cut away to show a cross section similar to the view of FIG. 6, and with the lower torso rotated relative to the upper torso to activate the actuation mechanism.

Arm-rotating mechanism 28 disposed within upper torso 16 may include positioning disc 114, securing pin 124, and pin-biasing element 130. Positioning disc 114 fixedly mounts to shoulder flange 42 where securing pin 124 in conjunction with pin-biasing element 130 push against positioning disc 114 to allow retention of shoulder flange 42 in a desired position. FIGS. 5-7 show positioning disc 114 as a pinion with twelve teeth allowing for twelve unique positions. Pin-biasing element 130 is shown as a coil spring connected to upper torso 16 as the base and securing pin 124.

Actuating mechanism 60 may further include pivoting lever 32, which has upper end 36 and lower end 34. Upper end 36 operatively connects to extendable arm 20, while forced movement of lower end 34 pushes upper end 36 into extendable arm 20 to cause extendable arm 20 to straighten.

Intermediate pivot 50 of the pivoting lever 32 connects the upper end 36 and the lower end 34 to actuating mechanism 60. Upper end 36 and lower end 34 may be two separate pieces where bias element 52 provides stress relief when upper end 36 is forced in the same direction as lower end 34. Bias element 52 may be a leaf spring that operates around intermediate pivot 50, or a more flexible portion of pivoting lever 32.

As mentioned above, an activation switch may be disposed in lower torso 16 exposed under the foot. For example, when toy figure 10 lands on solid ground, this foot-disposed activation switch compresses, activating a relevant sequence by a sound emitting element and/or a light emitting element to give the auditory and visual impression of a superhero landing from flight, falling or large jump. When toy figure 10 comes off of solid ground, this foot-disposed activation switch may release and activate a relevant sequence by the sound emitting element and/or the light emitting element to give the auditory and visual impression of a superhero taking flight or large jump.

In some embodiments, toy figure 10 includes upper torso 16, pivoting lever 32 pivotally mounted within upper torso 16, shoulder flange 42 rotatably mounted on upper torso 16 with a passageway extending from within upper torso 16, upper arm 22 pivotally mounted to shoulder flange 42, and plunger 40 slidably connecting pivoting lever 32 to upper arm 22 through the passageway of shoulder flange 42. For example, pivoting lever 32 may pivot relative to upper torso 16 and push plunger 40 through the passageway of shoulder flange 42 where plunger 40 forces upper arm 22 to pivot relative to shoulder flange 42.

Lower arm 24 pivotally mounts to upper arm 22 with tie rod 48 interconnecting shoulder flange 42 to lower arm 24 so that pivotal movement of upper arm 22 relative to shoulder flange 42 causes lower arm 24 to pivot relative to upper arm 22. Incorporating the embodiment above, when pivoting lever 32 pivots and pushes on plunger 40, upper arm 22 pivots relative to shoulder flange 42. Since upper arm 22 pivotally mounts to lower arm 24 and tie rod 48 interconnects shoulder flange 42 to lower arm 24, pivotal movement of upper arm 22 causes pivotal movement of lower arm 24 by way of tie rod 48 and shoulder flange 42. Thus, pivotal movement of pivoting lever 32 pushing on plunger 40 causes a chain reaction of pivotal movements where upper arm 22 pivots relative to shoulder flange 42 and lower arm 24 pivots relative to upper arm 22.

Furthermore, lower torso 14 rotatably mounts to upper torso 16 and operatively connects to pivoting lever 32, wherein rotation of lower torso 14 forces pivoting lever 32 to pivot with respect to upper torso 16 simultaneously causing, as explained above, pivoting of upper arm 22 with respect to shoulder flange 42 and pivoting of lower arm 24 with respect to upper arm 22.

Lower torso 14 further includes waist-biasing element 54 operatively connecting to upper torso 16, such that lower torso 14 may rotate in any direction relative to upper torso 16 and be urged back to the unrotated position. FIG. 7 shows waist-biasing element 54 as a spring coiled around the spine of lower torso 14. Each end of the spring operatively contacts their respective side of upper torso 16 and the spine has a stopper that prevents each side of the spring from rotating past a certain point and creating the opposite force necessary to bias waist 18.

As described above, when rotating upper torso 16 relative to lower torso 14, upper arm 22 pivots relative to shoulder flange 42 and lower arm 24 pivots relative to upper arm 22 simulating a punching action. An electric activation switch, not shown, may trigger associated electronics to produce an appropriate sequence that may make the punching action appear more realistic. In another example, not shown, toy figure 10 is Superman and an electric switch is connected to the well-known shield-shaped "S" crest located on the chest of toy figure 10. Pushing on Superman's "S" crest will appear to bring Superman to life and make him speak.

Some embodiments of action figure 10 include swivel waist 18 joining upper torso 16 and lower torso 14, and further include a rotating and pivoting shoulder flange 42 that joins upper arm 22 to upper torso 16 with plunger 40 extending through shoulder flange 42. Plunger 40 may push upper arm 22, thereby forcing upper arm 22 to pivot around shoulder flange 42. Upper arm 22 is pivotally joined to lower arm 24 by a bending elbow 46 and a tie rod 48 that interconnects shoulder flange 42 to lower arm 24 so that lower arm 24 bends relative to upper arm 22 as upper arm 22 pivots around shoulder flange 42.

Accordingly, swiveling waist 18 causes plunger 40 to extend through shoulder flange 42 and force upper arm 22 to pivot relative to shoulder flange 42, and consequently, lower arm 24 to bend relative to upper arm 22. As shown in FIG. 7, for example, twisting action figure 10 about waist 18 will send plunger 40 in motion causing upper arm 22 and lower arm 24 to rotate around shoulder flange 42 and straighten. From the perspective of a child playing with action figure 10, the function described above could simulate an arm-raising motion, a punching motion when straightening perpendicular from upper torso 16, or flying though the air and punching forward when straightening parallel from upper torso 16.

Waist 18 further includes waist-biasing element 54 operatively connected to upper torso 16 and lower torso 14 that allows forced swiveling of waist 18 and then returns waist 18 to the unswivelled position once force is no longer applied.

Preferably, action figure 10 includes pivoting lever 32 inside upper torso 16 with lower end 34 that is pushed by lower torso 14 and upper end 36 that pushes on plunger 40. For example, lower torso 14 may include driving lever 30 operatively connected to lower end 34 of pivoting lever 32, as shown in FIG. 7. Upon swiveling waist 18, lower torso 14 via driving lever 30 may move lower end 34 of pivoting lever 32 and as a result moving upper end 36 in the opposite direction. Upper end 36 would then push on plunger 40 sending upper arm 22 and lower arm 24 in motion, as described above.

Additionally, pivoting lever 32 may include intermediate pivot 50 that allows forced bending of pivoting lever 32 to relieve stresses that might be forced by pushing upper arm 22 counter to swiveling waist 18. This may be an important durability feature for action figure 10 in a situation where a child prevents upper arm 22 and lower arm 24 from moving while twisting waist 18. In this situation, plunger 40 would push back against upper end 36 of pivoting lever 32 as lower torso 14 attempts to force lower end 34 of pivoting lever 32 in the opposite direction of plunger 40 creating stress on all internal moving parts. Thus, intermediate pivot 50 connects and biases upper end 36 and lower end 34 of pivoting lever 32 relieving stress described above.

While embodiments of a twist-waist punching figure have been particularly shown and described, many variations may be made therein. This disclosure may include one or more independent or interdependent embodiments directed to various combinations of features, functions, elements and/or properties. Other combinations and sub-combinations of features, functions, elements and/or properties may be claimed later in a related application. Such variations, whether they are directed to different combinations or directed to the same combinations, whether different, broader, narrower or equal in scope, are also regarded as included within the subject matter of the present disclosure. Accordingly, the foregoing embodiments are illustrative, and no single feature or element, or combination thereof, is essential to all possible combinations that may be claimed in this or a later application.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

The following reference numerals appear in the drawings:

| | |
|---|---|
| 10 | toy figure, action figure |
| 12 | body |
| 14 | lower torso |
| 16 | upper torso, rotatably mounted on the lower torso |
| 18 | waist, swivel waist |
| 20 | extendable arm, mounted on the upper torso |
| 22 | upper arm |
| 24 | lower arm |
| 26 | hand, rotatably mounted |
| 28 | arm-rotating mechanism |
| 30 | driving lever |
| 32 | pivoting lever, lever |
| 34 | lower end |
| 36 | upper end |
| 38 | pintle |
| 40 | plunger, arm lever |
| 42 | shoulder flange |
| 44 | arm-biasing element coil spring |
| 46 | elbow |
| 48 | tie rod, link, bent wire |
| 50 | intermediate pivot, spring loaded pivot |
| 52 | stress relief, spring, bias element |
| 54 | waist-biasing element |
| 60 | actuating mechanism |
| 74 | Legs |
| 80 | arcuate opening |
| 82 | center point |
| 84 | outer end |
| 86 | post |
| 88 | inner end |
| 90 | paddle |
| 92 | surface |
| 100 | axle |
| 102 | shoulder end |
| 104 | elbow end |
| 106 | elbow end |
| 108 | axle |
| 110 | hole |
| 112 | hand end |
| 114 | positioning disc |
| 116 | center opening |
| 118 | wavy surface |
| 120 | higher portion |
| 122 | lower portion |
| 124 | securing pin |
| 126 | pin-channel |
| 128 | narrowing end |
| 130 | pin-biasing element |

What is claimed is:

1. A toy figure, comprising:

an upper torso;

a pivoting lever disposed within the upper torso;

a shoulder flange rotatably mounted to the upper torso and including a passageway extending from within the upper torso;

an upper arm pivotally mounted to the shoulder flange;

a sliding plunger operatively connecting the pivoting lever to the upper arm through the passageway, the pivoting lever being configured to slide the plunger through the shoulder flange thereby forcing the upper arm to pivot with respect to the shoulder flange;

a lower arm pivotally mounted to the upper arm;

a tie rod interconnecting the shoulder flange to the lower arm so that pivotal movement of the upper arm around the shoulder flange causes the lower arm to pivot with respect to the upper arm;

a lower torso rotatably mounted to the upper torso and operatively connected to the pivoting lever;

wherein rotation of the lower torso is configured to force the pivoting lever to pivot with respect to the upper torso thereby causing simultaneous pivoting of the upper arm with respect to the shoulder flange and pivoting of the lower arm with respect to the upper arm.

2. The toy figure according to claim 1, further comprising an actuating mechanism disposed within the upper torso.

3. The toy figure according to claim 2, wherein the actuating mechanism further comprises a sound emitting element such that actuating the actuating mechanism causes the sound emitting element to emit sound.

4. The toy figure according to claim 2, wherein the actuating mechanism further comprises a light emitting element such that actuating the actuating mechanism causes the light emitting element to emit light.

5. The toy figure according to claim 2, wherein the actuating mechanism further comprises an activation switch that triggers activation of the actuating mechanism.

6. The toy figure according to claim 2, wherein the actuating mechanism further comprises an activation pushbutton operatively connected to the upper torso such that manual activation of the actuating mechanism is configured to be triggered from the outside of the toy figure.

7. The toy figure according to claim 1, wherein the lower torso further comprises a waist-biasing element that operatively connects to the upper torso, such that the lower torso is configured to rotate relative to the upper torso and be urged back to an unrotated position.

8. The toy figure according to claim 1, wherein the lower arm further includes a rotatably mounted hand.

9. An action figure comprising:

an upper torso;

a lower torso;

an upper arm;

a lower arm;

a swivel waist joining the upper torso to the lower torso;

a rotating shoulder flange joining the upper arm to the upper torso, the upper arm being pivotally mounted to the shoulder flange;

a plunger extending through the shoulder flange and configured to push the upper arm to cause the upper arm to pivot around the shoulder flange;

a bending elbow joining the lower arm to the upper arm; and a tie rod interconnecting the shoulder flange to the lower arm, the tie rod being configured to cause the lower arm to bend relative to the upper arm as the upper arm pivots around the shoulder flange;

wherein swiveling the waist is configured to extend the plunger further through the shoulder flange thereby causing the plunger to push on the upper arm, the upper arm to pivot relative to the shoulder flange, and the lower arm to bend relative to the upper arm.

10. The action figure according to claim 9, further comprising a pivoting lever inside the upper torso with a lower end configured to be pushed by the lower torso and an upper end configured to push on the plunger.

11. The action figure according to claim 9, wherein the lever inside the upper torso includes an intermediate pivot with a spring that allows forced bending of the lever to relieve stresses caused by pushing the upper arm or lower arm counter to swiveling the waist.

12. The action figure according to claim 9, wherein the waist includes a waist-biasing element operatively connected to the upper torso and the lower torso, and configured to allow forced swiveling of the waist and to cause return of the waist to an unswivelled position.

* * * * *